US012674297B1

(12) United States Patent
Sigle

(10) Patent No.: US 12,674,297 B1
(45) Date of Patent: Jul. 7, 2026

(54) FUNNEL ATTACHMENT FOR A HEAVY MACHINERY BUCKET

(71) Applicant: William Sigle, Stockton, NJ (US)

(72) Inventor: William Sigle, Stockton, NJ (US)

( * ) Notice: Subject to any disclaimer, the term of this patent is extended or adjusted under 35 U.S.C. 154(b) by 365 days.

(21) Appl. No.: 18/488,090

(22) Filed: Oct. 17, 2023

(51) Int. Cl.
*E02F 3/40* (2006.01)
*E02F 3/407* (2006.01)

(52) U.S. Cl.
CPC ..... *E02F 3/404* (2013.01); *E02F 3/407* (2013.01)

(58) Field of Classification Search
CPC ..... E02F 3/404; E02F 3/407; E02F 3/3417; E02F 3/402; E02F 3/405; E02F 3/413; E02F 3/36; E02F 3/4075
See application file for complete search history.

(56) References Cited

U.S. PATENT DOCUMENTS 3,517,863 A * 6/1970 Graham ..... B28C 7/06 222/460
3,598,266 A * 8/1971 Fisher ..... E02F 3/401 414/726
5,123,185 A * 6/1992 Pollard ..... E02F 3/404 37/406
5,564,886 A 10/1996 Emerson
5,692,875 A * 12/1997 Boman ..... E02F 3/404 37/903
5,885,053 A 3/1999 Deye
5,938,398 A 8/1999 Brown
7,281,838 B2 10/2007 Melchiorre
D630,653 S 1/2011 Meritt
7,934,899 B2 5/2011 Downing
2005/0220603 A1 10/2005 Graham
2009/0211121 A1* 8/2009 Doster, Jr. ..... E02F 3/404 37/468
2023/0047650 A1* 2/2023 Hefner ..... E02F 3/4075

* cited by examiner

*Primary Examiner* — Christopher J Sebesta
*Assistant Examiner* — Blake E Scoville

(57) ABSTRACT

The funnel attachment for a heavy machinery bucket includes a funnel and one or more hydraulic pistons. The funnel may be pivotably coupled to a bucket of a loader. The one or more hydraulic pistons may pivot the funnel between a funnel lifted position and a funnel lowered position. The funnel may be pivoted to the funnel lifted position in order to fill the bucket with material. The funnel may be pivoted to the funnel lowered position to empty the bucket through the funnel. As non-limiting examples, the loader may include a backhoe loader, a front loader, a wheel loader, a skid steer loader, or a track loader and the material may comprise sand, gravel, or soil.

15 Claims, 6 Drawing Sheets

FUNNEL ATTACHMENT FOR A HEAVY MACHINERY BUCKET

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of heavy equipment machines and material handling, more specifically, a funnel attachment for a heavy machinery bucket.

SUMMARY OF INVENTION

The funnel attachment for a heavy machinery, OEM, or after-market bucket comprises a funnel and one or more hydraulic pistons. The funnel may be pivotably coupled to a bucket of a loader. The one or more hydraulic pistons may pivot the funnel between a funnel lifted position and a funnel lowered position. The funnel may be pivoted up to the funnel lifted position for self-loading in order to fill the bucket with material. The funnel may be pivoted to the funnel lowered position to empty the bucket through the funnel. As non-limiting examples, the loader may comprise a backhoe loader, a front loader, a wheel loader, a telehandler, a skid steer loader, or a track loader and the material may comprise sand, gravel, or soil.

An object of the invention is to provide a funnel that may be pivotably coupled to the front of the bucket of a loader.

Another object of the invention is to provide one or more hydraulic pistons that may pivot the funnel between a funnel lifted position and a funnel lowered position.

A further object of the invention is to provide a bucket interface that may pivotably couple the funnel to the bucket.

Yet another object of the invention is to provide an interface lateral bar such that the one or more hydraulic pistons may couple between the interface later bar and the top of the bucket.

These together with additional objects, features and advantages of the funnel attachment for a heavy machinery bucket will be readily apparent to those of ordinary skill in the art upon reading the following detailed description of the presently preferred, but nonetheless illustrative, embodiments when taken in conjunction with the accompanying drawings.

In this respect, before explaining the current embodiments of the funnel attachment for a heavy machinery bucket in detail, it is to be understood that the funnel attachment for a heavy machinery bucket is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the funnel attachment for a heavy machinery bucket.

It is therefore important that the claims be regarded as including such equivalent construction insofar as they do not depart from the spirit and scope of the funnel attachment for a heavy machinery bucket. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
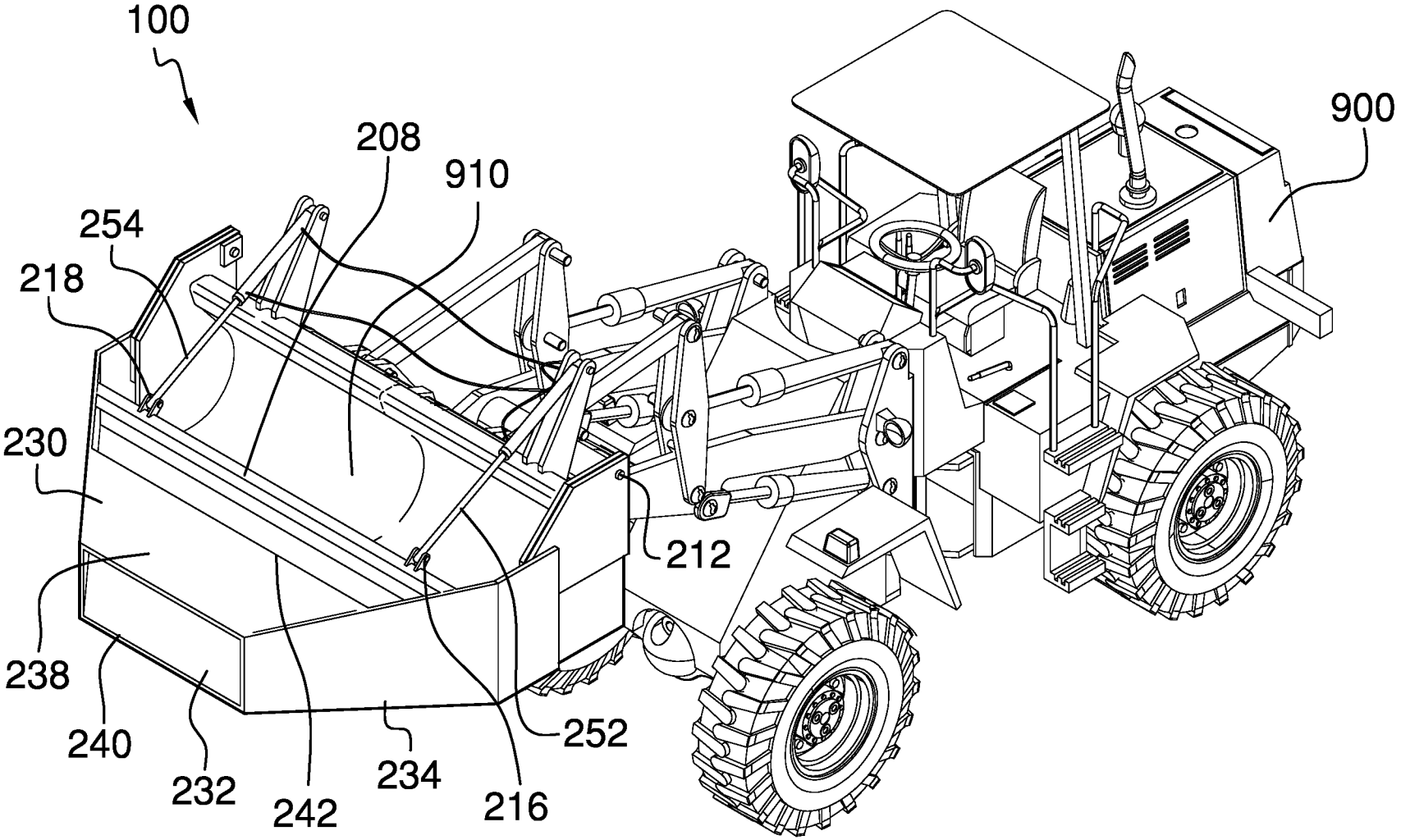
FIG. 1 is an isometric view of an embodiment of the disclosure.
Figure 2:
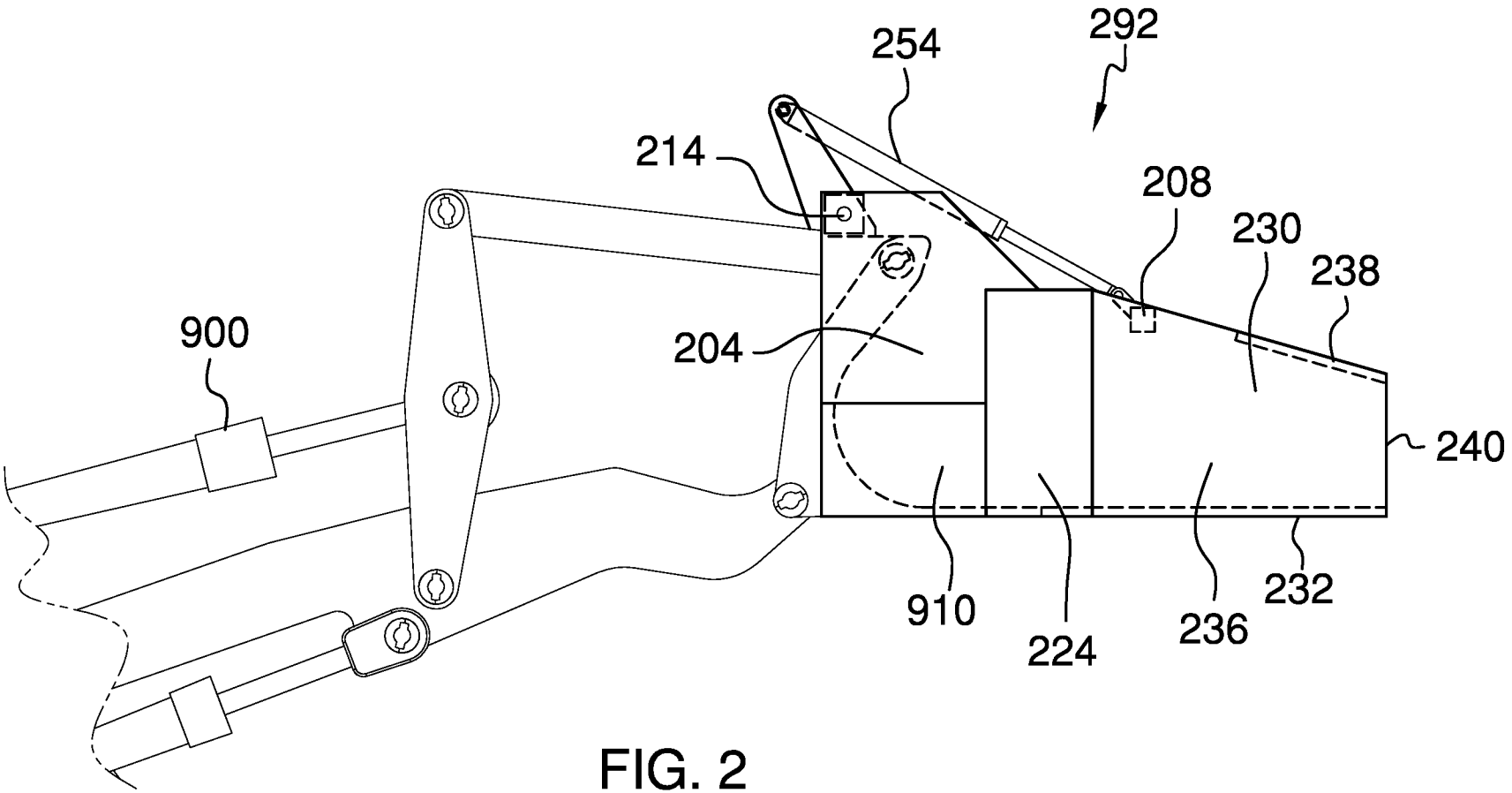
FIG. 2 is a right side view of an embodiment of the disclosure, illustrating the funnel in the funnel lowered position.
Figure 3:
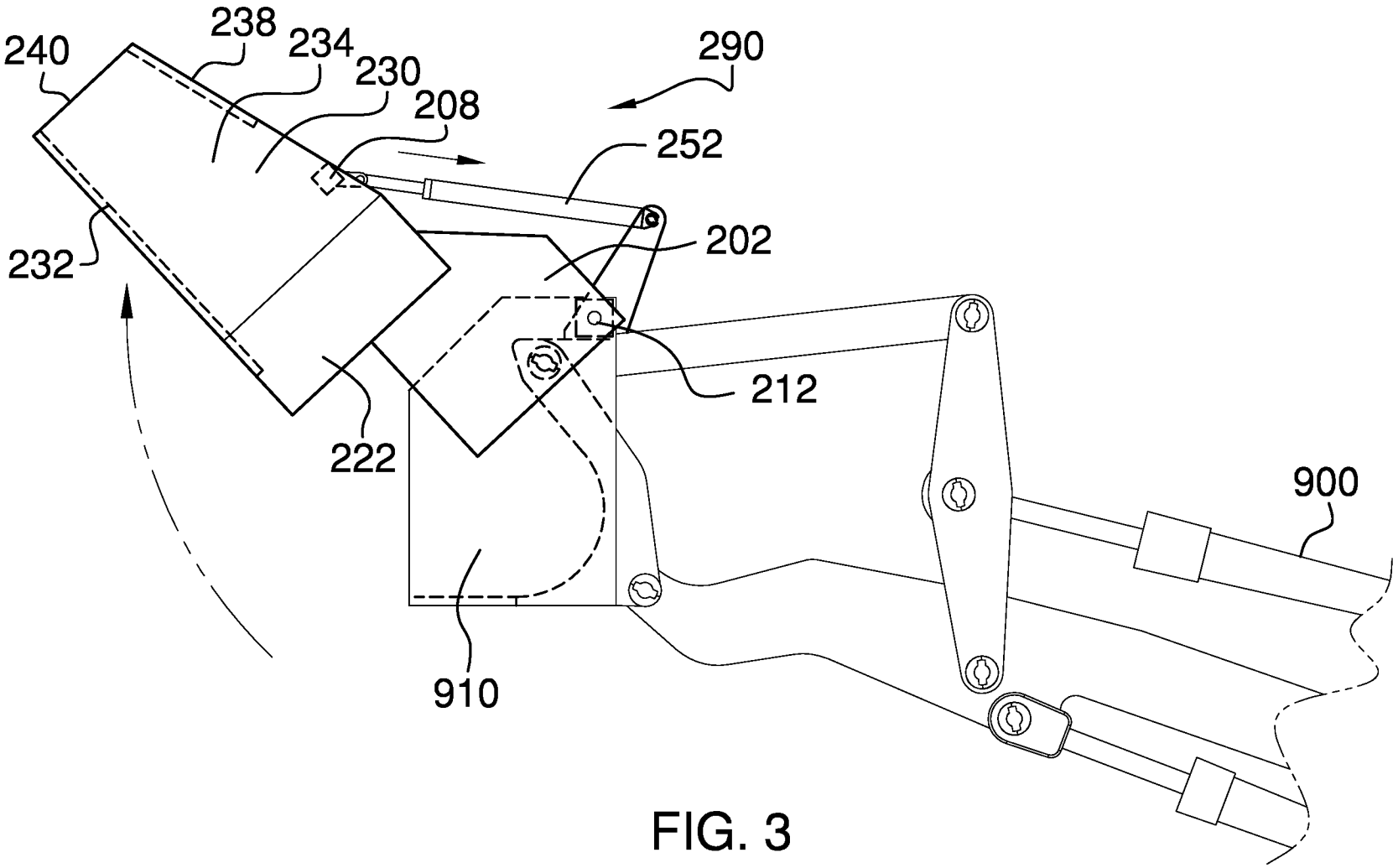
FIG. 3 is a left side view of an embodiment of the disclosure, illustrating the funnel in the funnel lifted position.
Figure 4:
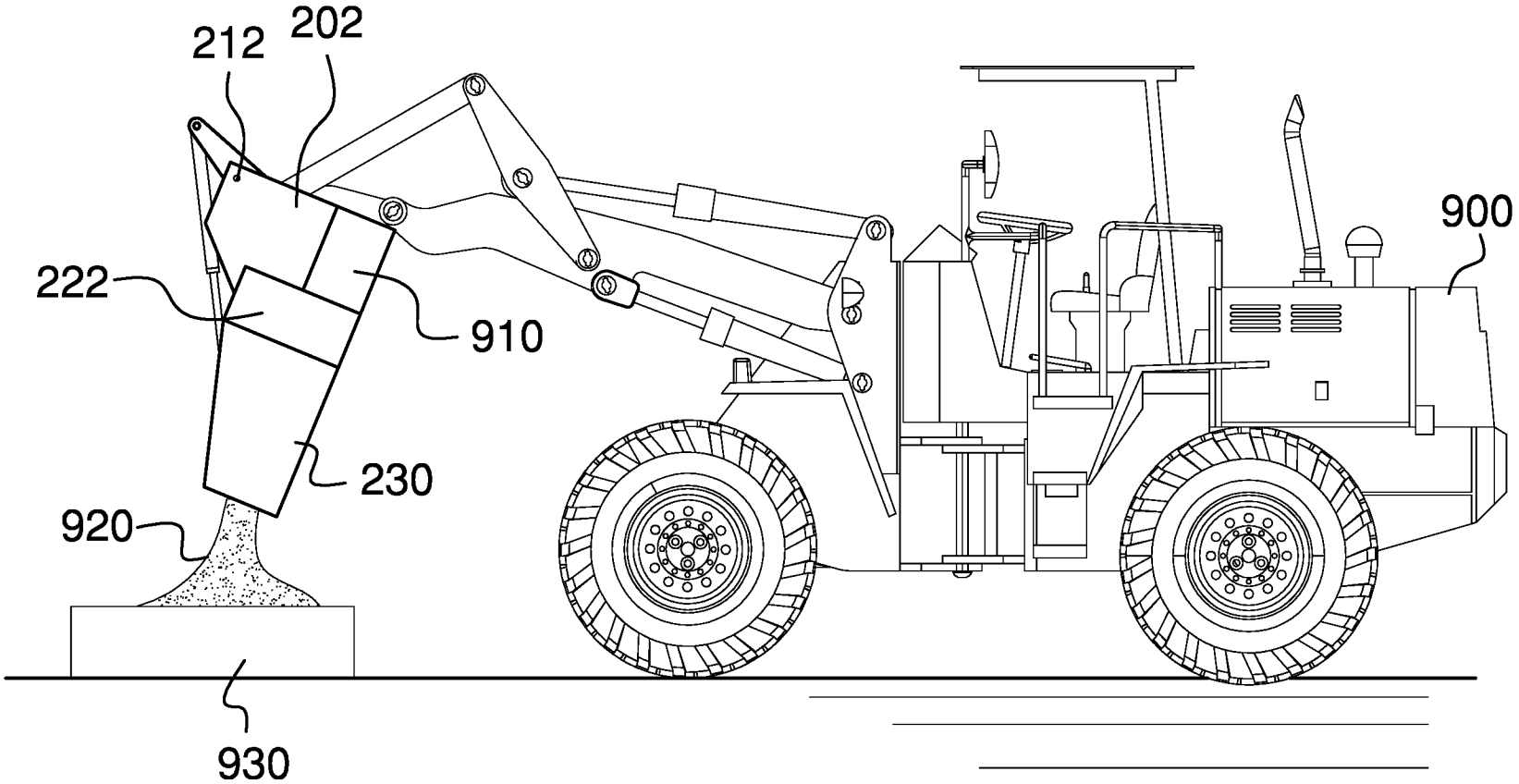
FIG. 4 is an in-use view of an embodiment of the disclosure, illustrating the material being poured from the bucket through the funnel.
Figure 5:
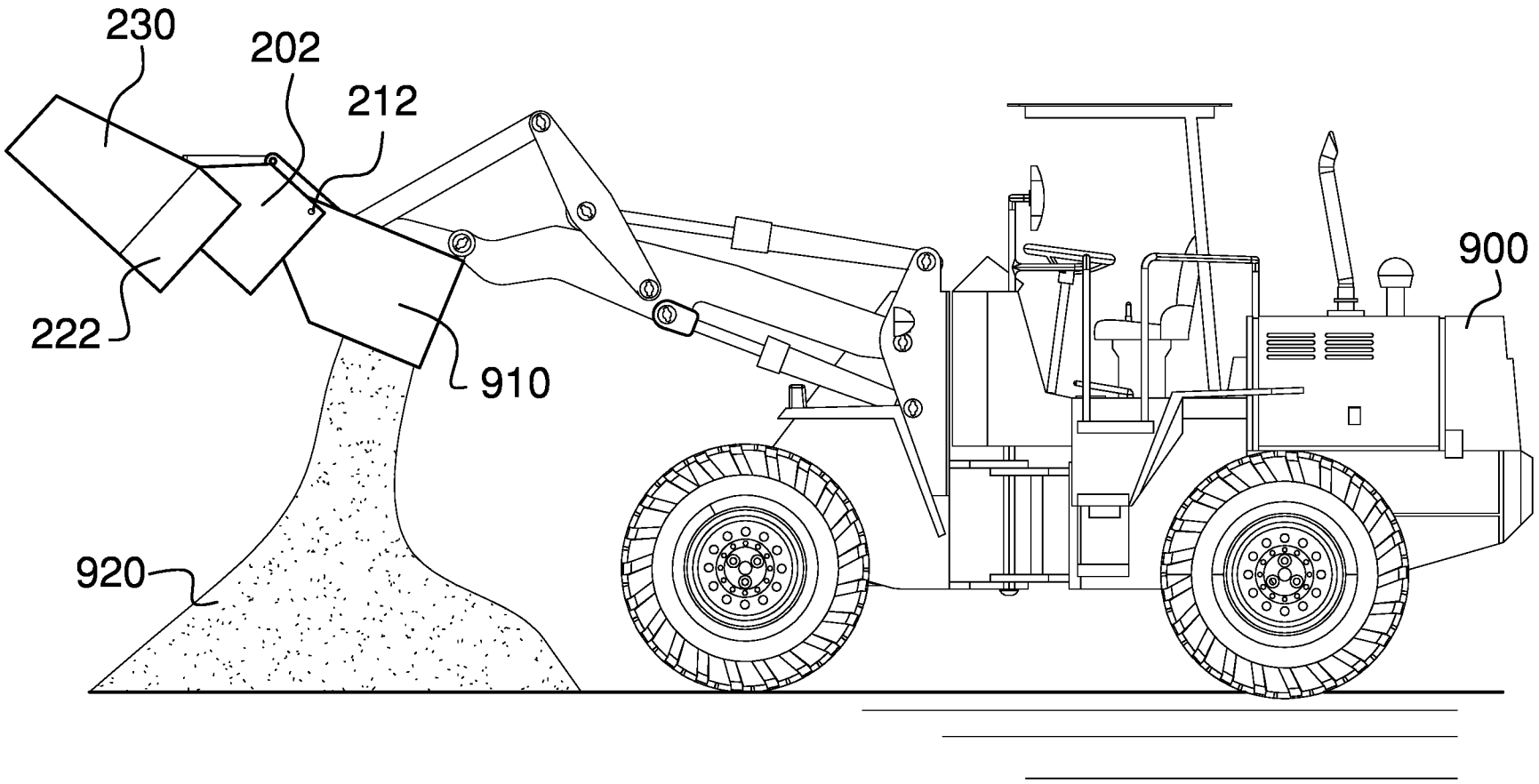
FIG. 5 is an in-use view of an embodiment of the disclosure, illustrating the material being poured from the bucket with the funnel lifted.
Figure 6:
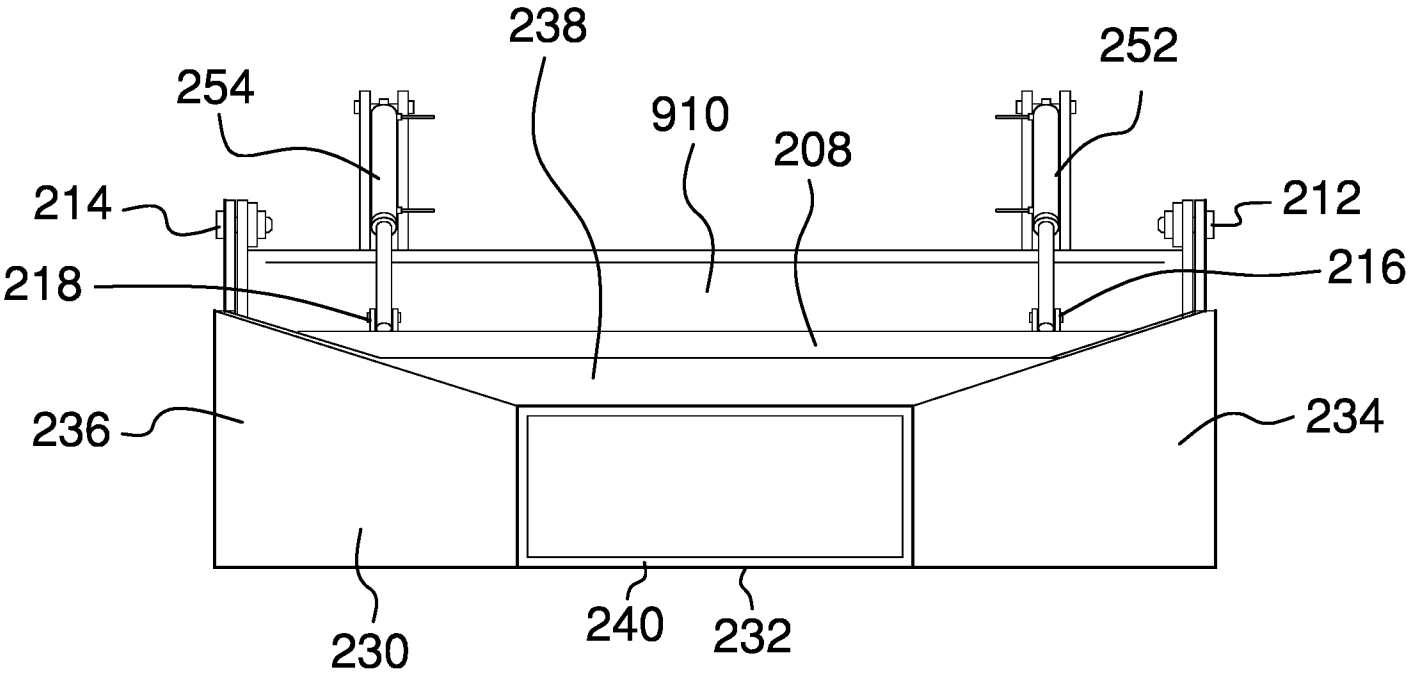
FIG. 6 is a front view of an embodiment of the disclosure.

Detailed reference will now be made to a first potential embodiment of the disclosure, which is illustrated in FIGS. 1 through 6.

The funnel attachment for a heavy machinery bucket 100 (hereinafter invention) comprises a funnel 230 and one or more hydraulic pistons. The funnel 230 may be pivotably coupled to a bucket 910 of a loader 900. The one or more hydraulic pistons may pivot the funnel 230 between a funnel lifted position 290 and a funnel lowered position 292. The funnel 230 may be pivoted to the funnel lifted position 290 in order to fill the bucket 910 with material 920. The funnel 230 may be pivoted to the funnel lowered position 292 to empty the bucket 910 through the funnel 230. As non-limiting examples, the loader 900 may comprise a backhoe loader, a front loader, a wheel loader, a 23 skid steer loader, or a track loader and the material 920 may comprise sand, gravel, soil.

The funnel 230 may be a hollow structure comprising a front aperture 240 and a rear aperture 242. The material 920 may be poured into the funnel 230 from the bucket 910 via the rear aperture 242 and may exit the funnel 230 via the front aperture 240. The front aperture 240 may be smaller than the rear 8 aperture 242 such that the material 920 entering the rear aperture 242 may be guided to a destination 930 beyond the front aperture 240 where the destination 930 is smaller than the rear aperture 242. As non-limiting examples, the destination 930 may be a destination aperture or a bin.

The funnel 230 may have a rectangular cross-section. The funnel 230 may comprise a funnel bottom wall 232, a funnel left side wall 234, a funnel right side wall 236, and a funnel top wall 238. The funnel bottom wall 232, the funnel left side wall 234, the funnel right side wall 236, and the funnel top wall 238 may each be the shape of a trapezoid. The parallel edges of the trapezoids may define the front and rear of the funnel 230. Specifically, the smaller parallel edge may define the front of the funnel 230 and the larger parallel edge may define the rear of the funnel 230.

The funnel left side wall 234 may comprise a funnel left side extension 222. The funnel left side extension 222 may change the orientation of the funnel left side wall 234 such that the funnel left side wall 234 may extend rearward parallel to the left side of the bucket 910. The funnel right side wall 236 may comprise a funnel right side extension 224. The funnel right side extension 224 may change the orientation of the funnel right side wall 236 such that the funnel right side wall may extend rearward parallel to the right side of the bucket 910. The funnel left side extension 222 may be oriented to be parallel to the funnel right side extension 224.

A bucket interface may pivotably couple the funnel 230 to the bucket 910. The bucket interface may comprise an interface left side wall 202, an interface right side wall 204, and an interface lateral bar 208. The bucket interface may align the funnel 230 with the bucket 910 such that the funnel bottom wall 232 butts against the bottom of the bucket 910 when the funnel 230 is in the funnel lowered position 292 thus making the funnel 230 an extension of the bucket 910.

The front of the interface left side wall 202 may be coupled to the funnel left side extension 222. The upper rear of the interface left side wall 202 may be pivotably couple to the bucket 910 via an interface left attachment hinge 212. The front of the interface right side wall 204 may be coupled to the funnel right side extension 224. The upper rear of the interface right side wall 204 may be pivotably couple to the bucket 910 via an interface right attachment hinge 214.

The interface lateral bar 208 may be coupled laterally between the top of the funnel left side wall 234 and the top of the funnel right side wall 236. The interface lateral bar 208 may comprise one or more piston couplers. The piston rods of the one or more hydraulic pistons may be pivotably coupled to the one or more piston couplers.

The one or more hydraulic pistons may be coupled between the interface lateral bar 208 and the top of the bucket 910. The one or more hydraulic pistons may pivot the funnel 230 between the funnel lowered position 292 and the funnel lifted position 290. Specifically, the one or more hydraulic pistons may pivot the funnel 230 to the funnel lowered position 292 when the one or more hydraulic pistons are extended and the one or more hydraulic pistons may pivot the funnel 230 to the funnel lifted position 290 when the one or more hydraulic pistons are retracted.

In a preferred embodiment, there may be two hydraulic pistons. A left hydraulic piston 252 may be pivotably coupled between a left piston coupler 216 and the left top of the bucket 910 and a right hydraulic piston 254 may be pivotably coupled between a right piston coupler 218 and the right top of the bucket 910. The left hydraulic piston 252 and the right hydraulic piston 254 may be adapted to move simultaneously under control of a user in order to pivot the funnel 230.

To load the bucket 910, the funnel 230 may be pivoted to the funnel lifted position 290, the bucket 910 may be lowered to the ground, the loader 900 may be driven forward to push the bucket 910 into the material 920, and the bucket 910 may be tilted rearward and elevated to retain the material 920 in the bucket 910. To unload the bucket 910 through the funnel 230, the funnel 230 may be pivoted to the funnel lowered position 292, the loader 900 may be maneuvered to position the bucket 910 above the destination 930, and the bucket 910 may be tilted 19 forward to pour the material 920 from the bucket 910 through the funnel 230.

In use, the bucket 910 may be loaded by pivoting the funnel 230 to the funnel lifted position 290, lowering the bucket 910 to the ground, driving the loader 900 forward to push the bucket 910 into the material 920, tilting the bucket 910 rearward, and elevating the bucket 910 to retain the material 920 in the bucket 910. The bucket 910 may be unloaded through the funnel 230 by pivoting the funnel 230 to the funnel lowered position 292, maneuvering the loader 900 to position the bucket 910 above the destination 930, and tilting the bucket 910 forward to pour 9 the material 920 from the bucket 910 through the funnel 230.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "aperture" may be an opening in a surface or object. Aperture may be synonymous with hole, slit, crack, gap, slot, or opening.

As used herein, the words "couple", "couples", "coupled" or "coupling", may refer to connecting, either directly or indirectly, and does not necessarily imply a mechanical connection.

As used in this disclosure, a "cross-section" may be a surface or shape that would be exposed by making a straight cut through an object.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used in this disclosure, a "hinge" may be a device that permits the turning, rotating, or pivoting of a first object relative to a second object.

As used in this disclosure, the word "lateral" may refer to the sides of an object or movement towards a side. Lateral directions are generally perpendicular to longitudinal directions. "Laterally" may refer to movement in a lateral direction.

As used in this disclosure, "orientation" may refer to the positioning and/or angular alignment of a first object relative to a second object or relative to a reference position or reference direction.

As used herein, the word "pivot" may include any mechanical arrangement that allows for rotational motion. Non-limiting examples of pivots may include hinges, holes, posts, dowels, pins, points, rods, shafts, balls, and sockets, either individually or in combination.

As used herein, "rectangle" and "rectangular" may refer to a closed figure comprising four straight lines joined by four right angles. The opposing sides of a rectangle have equal length. A square is considered to be a special type of rectangle where all four sides are the same length. An object may still be considered to have a generally rectangular shape even if corners of the object are rounded off as long as two sets of opposing, straight-line, perpendicular sides are apparent.

As used in this disclosure, a "trapezoid" may be a quadrilateral with one pair of parallel sides. An isosceles trapezoid is a trapezoid for which a line of symmetry intersects opposite sides of the trapezoid and bisects the trapezoid into two congruent shapes or structures.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A funnel attachment for a heavy machinery bucket comprising:

a funnel and one or more hydraulic pistons;

wherein the funnel is pivotably coupled to a bucket of a loader;

wherein the one or more hydraulic pistons pivot the funnel between a funnel lifted position and a funnel lowered position;

wherein the funnel is pivoted to the funnel lifted position in order to fill the bucket with material;

wherein the funnel is pivoted to the funnel lowered position to empty the bucket through the funnel;

wherein the funnel is a hollow structure comprising a front aperture and a rear aperture;

wherein the material is poured into the funnel from the bucket via the rear aperture and exits the funnel via the front aperture;

wherein the funnel comprises a funnel bottom wall, a funnel left side wall, a funnel right side wall, and a funnel top wall;

wherein the funnel left side wall comprises a funnel left side extension;

wherein the funnel left side extension changes the orientation of the funnel left side wall such that the funnel left side wall extends rearward parallel to the left side of the bucket;

wherein the funnel right side wall comprises a funnel right side extension;

wherein the funnel right side extension changes the orientation of the funnel right side wall such that the funnel right side wall extends rearward parallel to the right side of the bucket;

wherein a bucket interface pivotably couples the funnel to the bucket;

wherein the bucket interface aligns the funnel with the bucket such that the funnel bottom wall butts against a bottom of the bucket when the funnel is in the funnel lowered position thus making the funnel an extension of the bucket.

2. The funnel attachment for a heavy machinery bucket according to claim 1 wherein the front aperture is smaller than the rear aperture such that the material entering the rear aperture is guided to a destination beyond the front aperture where the destination is smaller than the rear aperture.

3. The funnel attachment for a heavy machinery bucket according to claim 2 wherein the funnel has a rectangular cross-section.

4. The funnel attachment for a heavy machinery bucket according to claim 3 wherein the funnel bottom wall, the funnel left side wall, the funnel right side wall, and the funnel top wall are each the shape of a trapezoid;

wherein the parallel edges of the trapezoids define the front and rear of the funnel;

wherein the smaller parallel edge defines the front of the funnel and the larger parallel edge defines the rear of the funnel.

5. The funnel attachment for a heavy machinery bucket according to claim 4 wherein the funnel left side extension is oriented to be parallel to the funnel right side extension.

6. The funnel attachment for a heavy machinery bucket according to claim 5 wherein the bucket interface comprises an interface left side wall, an interface right side wall, and an interface lateral bar.

7. The funnel attachment for a heavy machinery bucket according to claim 6 wherein the front of the interface left side wall is coupled to the funnel left side extension;

wherein the upper rear of the interface left side wall is pivotably couple to the bucket via an interface left attachment hinge.

8. The funnel attachment for a heavy machinery bucket according to claim 7 wherein the front of the interface right side wall is coupled to the funnel right side extension;

wherein the upper rear of the interface right side wall is pivotably couple to the bucket via an interface right attachment hinge.

9. The funnel attachment for a heavy machinery bucket according to claim 8 wherein the interface lateral bar is coupled laterally between the top of the funnel left side wall and the top of the funnel right side wall;

wherein the interface lateral bar comprises one or more piston couplers;

wherein the piston rods of the one or more hydraulic pistons are pivotably coupled to the one or more piston couplers.

10. The funnel attachment for a heavy machinery bucket according to claim 9 wherein the one or more hydraulic pistons are coupled between the interface lateral bar and the top of the bucket.

11. The funnel attachment for a heavy machinery bucket according to claim 10 wherein the one or more hydraulic pistons pivot the funnel between the funnel lowered position and the funnel lifted position.

12. The funnel attachment for a heavy machinery bucket according to claim 11 wherein the one or more hydraulic pistons pivot the funnel to the funnel lowered position when the one or more hydraulic pistons are extended and the one or more hydraulic pistons pivot the funnel to the funnel lifted position when the one or more hydraulic pistons are retracted.

13. The funnel attachment for a heavy machinery bucket according to claim 12 wherein there are two hydraulic pistons;

wherein a left hydraulic piston is pivotably coupled between a left piston coupler and the left top of the bucket and a right hydraulic piston is pivotably coupled between a right piston coupler and the right top of the bucket;

wherein the left hydraulic piston and the right hydraulic piston are adapted to move simultaneously under control of a user in order to pivot the funnel.

14. A method for use with the funnel attachment for a heavy machinery bucket according to claim 12 wherein to load the bucket, the funnel is pivoted to the funnel lifted position, the bucket is lowered to the ground, the loader is driven forward to push the bucket into the material, and the bucket is tilted rearward and elevated to retain the material in the bucket.

15. A method for use with the funnel attachment for a heavy machinery bucket according to claim 14 wherein to unload the bucket through the funnel, the funnel is pivoted to the funnel lowered position, the loader is maneuvered to position the bucket above the destination, and the bucket is tilted forward to pour the material from the bucket through the funnel.

* * * * *